US007051401B2

(12) United States Patent
Park

(10) Patent No.: US 7,051,401 B2
(45) Date of Patent: May 30, 2006

(54) SUCTION NOZZLE FOR VACUUM CLEANER

(75) Inventor: Chang-Do Park, Changwon (KR)

(73) Assignee: LG Electronics Inc., Seoul (KR)

( * ) Notice: Subject to any disclaimer, the term of this patent is extended or adjusted under 35 U.S.C. 154(b) by 431 days.

(21) Appl. No.: 10/369,631

(22) Filed: Feb. 21, 2003

(65) Prior Publication Data

US 2004/0078922 A1 Apr. 29, 2004

(30) Foreign Application Priority Data

Oct. 23, 2002 (KR) ..... 10-2002-0065003

(51) Int. Cl.
*A47L 9/02* (2006.01)

(52) U.S. Cl. ..... 15/334; 15/328; 15/416; 15/419

(58) Field of Classification Search ..... 15/331, 15/334, 328, 416, 419
See application file for complete search history.

(56) References Cited

U.S. PATENT DOCUMENTS 1,129,174 A * 2/1915 Dennis ..... 15/334
2,046,684 A * 7/1936 Hoover ..... 15/334
2,156,805 A * 5/1939 Dow ..... 15/334
2,789,306 A * 4/1957 Kath ..... 15/331
2,898,621 A * 8/1959 Vance ..... 15/324
4,811,450 A * 3/1989 Steadings ..... 15/334
5,504,970 A * 4/1996 Neshat et al. ..... 15/334
5,560,074 A * 10/1996 Graham et al. ..... 15/334
5,787,546 A * 8/1998 Bass et al. ..... 15/334
6,519,805 B1 * 2/2003 Firdaus et al. ..... 15/334

FOREIGN PATENT DOCUMENTS

KR 1019970006484 4/1997

* cited by examiner

*Primary Examiner*—Theresa T. Snider
(74) *Attorney, Agent, or Firm*—Fleshner & Kim, LLP

(57) ABSTRACT

A suction nozzle for a vacuum cleaner is provided which includes a built in accessory tool. The suction nozzle includes a main body with an inlet which contacts the cleaning surface, and a connection portion which connects the main body of the nozzle to the vacuum cleaner. The nozzle also includes an accessory tool which communicates with the main body of the suction nozzle through a connection hose, and which, when extended, makes use of the suction force flowing through the main body of the suction nozzle. When not in use, the accessory tool is secured to the main body of the suction nozzle. In this manner, smaller, more narrow areas may be cleaned without first having to separate the suction nozzle from the vacuum cleaner in order to use an accessory tool.

23 Claims, 5 Drawing Sheets

SUCTION NOZZLE FOR VACUUM CLEANER

BACKGROUND OF THE INVENTION

1. Field of the Invention

The present invention relates to a suction nozzle for a vacuum cleaner, and more particularly, to a suction nozzle for a vacuum cleaner, which is formed integrally with an accessory tool capable of efficiently cleaning places such as corners.

2. Description of the Prior Art

A general vacuum cleaner will be first described with reference to FIG. 1. As shown in the figure, the general vacuum cleaner comprises a main body 2 for containing a motor capable of generating suction power, a connection hose 4 made of a flexible material and connected to the interior of the main body to communicate therewith, an extension tube 6 constructed such that it can be connected to the connection hose 4 and its length can be adjusted, and a suction nozzle 8 which is installed at a lower end of the extension tube 6 and sucks air containing foreign substances from a floor.

The main body 2 houses the motor for generating the suction power by forming vacuum as well as a filtering device for filtering out the foreign substances from the sucked air. A pair of wheels 2*a* are installed at lower portions of the main body 2 so that the main body 2 of the vacuum cleaner can be moved to a desired place. On one side of the main body are installed a power plug 2*b* for supply of electric power and a power cord connected thereto. The power cord is wound around a cord reel within the main body. A grip portion 5 which a user grasps with hands is detachably installed at an upper end of the extension tube 6. The grip portion 5 is provided with an operation button 5*a* for controlling an operation of the vacuum cleaner.

When cleaning is performed, the suction nozzle 8 sucks the air containing the foreign substances from a place to be cleaned by means of the suction power generated in the main body 2. The air sucked thus is introduced into the main body through the extension tube 6 and the connection hose 4. The foreign substances filtered out by the filtering device are collected on one side of the interior of the main body 2, and the filtered air passes by the motor to dissipate heat from the motor and then is discharged to the outside.

An open inlet through which the air is sucked is formed in a bottom face of the suction nozzle 8 for sucking the air containing the foreign substances from a floor to be cleaned. The suction nozzle 8 is constructed to be detachably coupled to the extension tube 6. Therefore, the suction nozzle 8 with a general configuration as shown in the figure is usually used for cleaning of large and flat places such as floors of rooms or living rooms. If necessary, the suction nozzle 8 is separated from the end of the extension tube 6 and then an additional tool such as a crevice tool or brush tool can be connected thereto. For example, in case of cleaning a very narrow place, the crevice tool instead of the suction nozzle 8 is connected to the extension tube 6. In case of cleaning upholstery, a sofa or the like, the brush tool with a brush attached to a front face of an inlet thereof is connected to the extension tube.

With the configuration of such a conventional suction nozzle, there is inconvenience in that in case of cleaning corner places, the vacuum cleaner can be used only when the suction nozzle 8 is separated from and then an additional accessory tool is connected to the extension tube.

SUMMARY OF THE INVENTION

The present invention is contemplated to solve the problem in the prior art. An object of the present invention is to provide a suction nozzle for a vacuum cleaner capable of cleaning corner or narrow places as well as a general floor.

According to the present invention for achieving the object, there is provided a suction nozzle for a vacuum cleaner, comprising a main body with an inlet for sucking air containing foreign substances; a connection portion formed at a rear surface of the main body of the suction nozzle for guiding the sucked air to a main body of the vacuum cleaner; an accessory tool that is formed to be smaller than the main body of the suction nozzle and has an inlet for sucking the air containing the foreign substances; and a connection hose for allowing the accessory tool to communicate with the interior of the main body of the suction nozzle.

With such a configuration, relatively wide places can be easily cleaned by the main body of the suction nozzle, and narrow places such as corners of stairs can also be easily cleaned by the accessory tool of the suction nozzle.

Preferably, the accessory tool is constructed to be detachably mounted on a side surface of the main body of the suction nozzle. For example, a vertical mounting protrusion is formed at the side surface of the suction nozzle and a mounting recess with a closed upper end into which the mounting protrusion is inserted is formed at a side surface of the accessory tool, so that the accessory tool can be detachably mounted on the main body of the suction nozzle.

Preferably, a connection duct communicating with the connection portion is installed in the main body of the suction nozzle, and an opening for guiding the air, which has been sucked into the main body of the suction nozzle, into the connection duct is formed at a front end of the connection duct.

A rear end of the connection hose of the accessory tool may be connected to the connection duct to communicate therewith in the main body of the suction nozzle. Alternatively, the rear end of the connection hose of the accessory tool may be connected to the connection portion to communicate therewith at a rear portion of the main body of the suction nozzle.

The suction nozzle may further comprise an opening/closing means for opening and closing the opening. The opening/closing means may comprise an opening/closing lever that is installed above the front end of the connection duct and is circular in cross section and an opening/closing plate for opening or closing the opening, the opening/closing lever is rotatably supported on the connection duct, and sidewall portions of the connection duct for defining the opening are formed in the shape of an arc, whereby the opening is opened or closed by means of the rotation of the opening/closing lever.

Preferably, the suction nozzle further comprises an agitator installed to be rotatably supported just above the inlet of the main body of the suction nozzle, and a rotating means for causing the agitator to rotate. The rotating means for causing the agitator to rotate may comprise, for example, a driving motor installed in the main body of the suction nozzle, and a belt for transmitting rotational force from the driving motor to the agitator.

With the use of the agitator, a surface of a carpet and the like can be easily cleaned.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
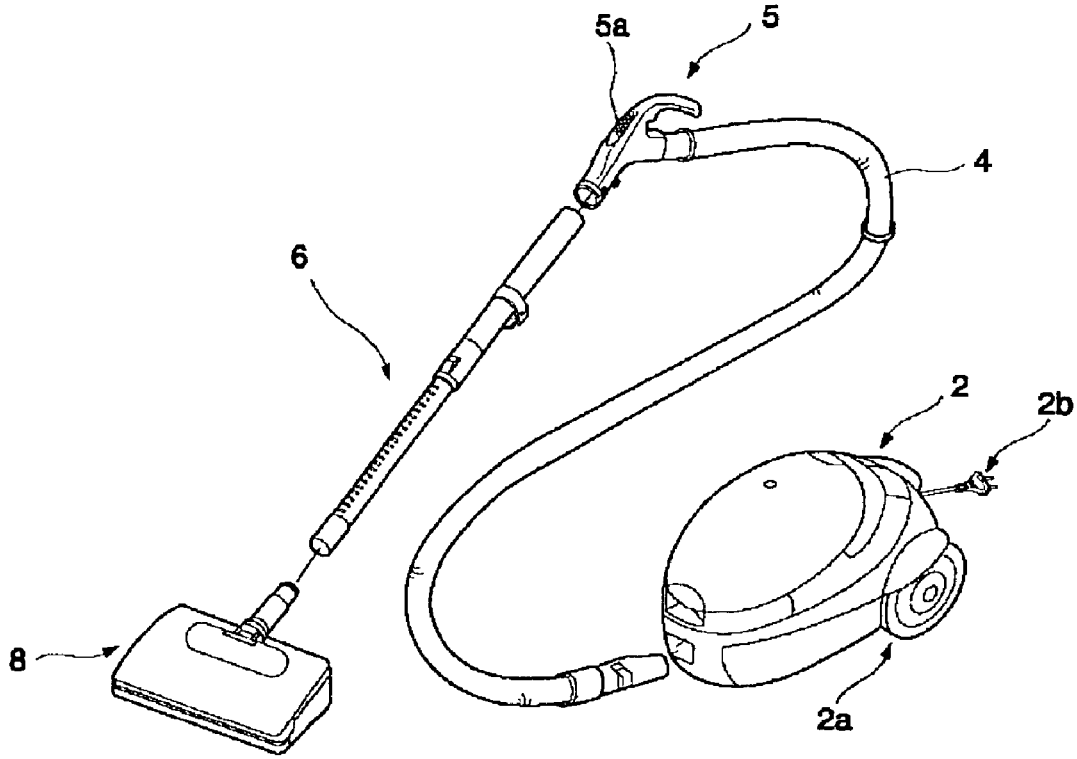
FIG. 1 is an exemplary perspective view of a general vacuum cleaner.
Figure 2:
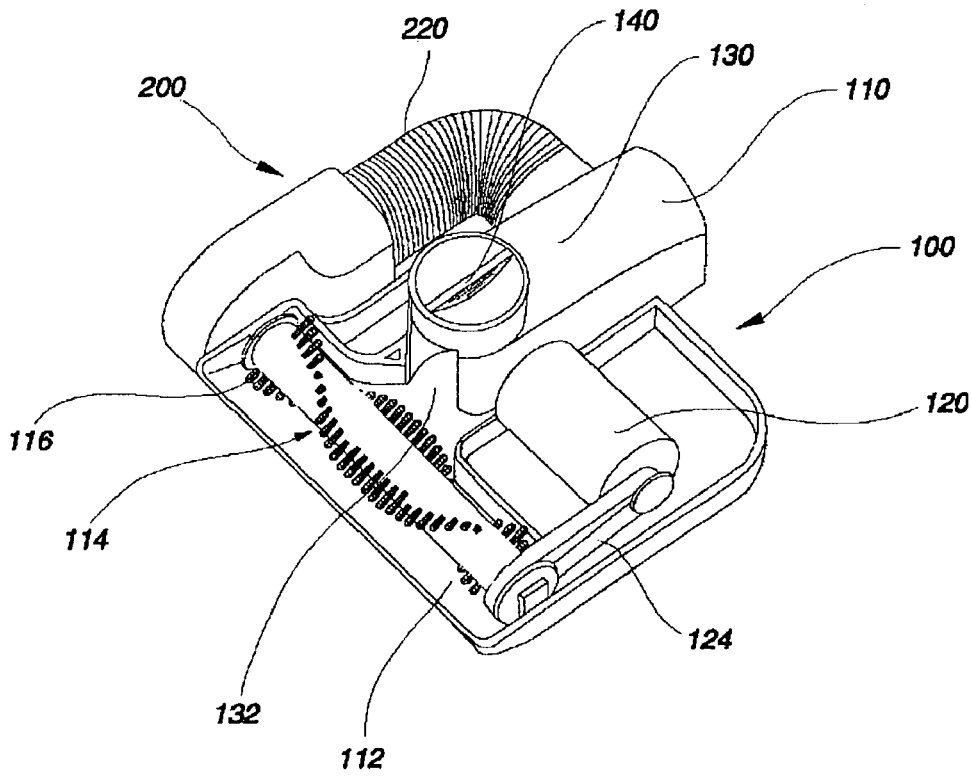
FIG. 2 is an exemplary perspective view of a suction nozzle of the present invention.

As shown in FIG. 2, a suction nozzle for a vacuum cleaner according to the present invention comprises a main body 100 with a bottom surface having a predetermined area so as to clean generally wide places, and an accessory tool 200 connected to and mounted on one side of the main body 100 through a connection hose 220 so as to clean narrow places.

Figure 3:
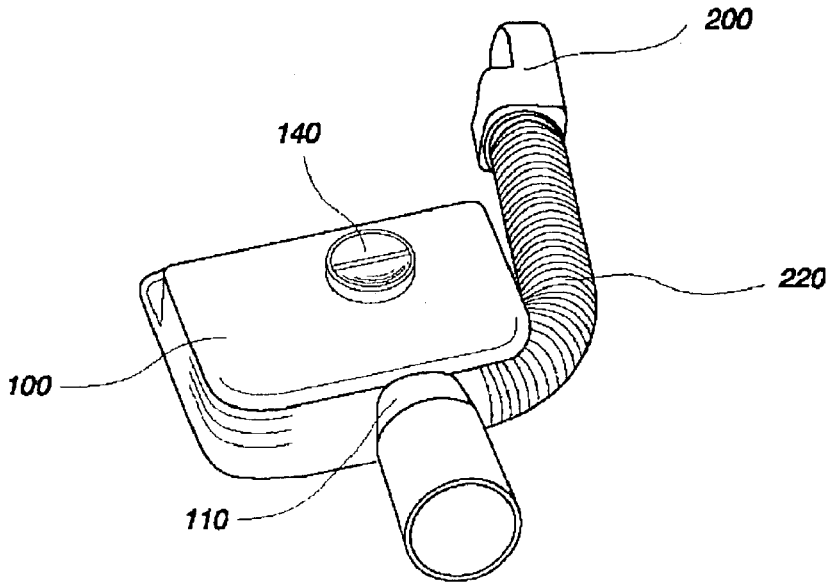
FIG. 3 is an exemplary perspective view showing a use state of the suction nozzle of the present invention.

The main body 100 is a portion for sucking air containing foreign substances from a general floor by using the bottom surface thereof having the predetermined area. Meantime, the accessory tool 200 is detachably installed on the main body 100, and thus, it can be used together with the main body 100 as shown in FIG. 3 or independently from the main body 100, if necessary. The accessory tool 200 of the present invention may be implemented in various configurations, e.g., a small crevice tool shown in the figure or a small brush tool.

Further, the main body 100 and the accessory tool 220 are connected to each other through the connection hose 220. The connection hose 220 is made of a flexible material, connects the one side of the main body 100 to the accessory tool 200 and causes the air containing the foreign substances introduced through the accessory tool 200 to be introduced into the main body 100.

The bottom surface of the main body 100 is formed with an inlet 112 for sucking the air by means of suction power generated in a main body of the vacuum cleaner. A connection portion 110 is formed at a rear end of the main body 100 to communicate with an extension tube of the vacuum cleaner. Therefore, the air sucked through the inlet 112 is guided into the connection portion 110.

In the present invention, the air sucked through the main body 100 and the accessory tool 200 is guided into the main body of the vacuum cleaner through the connection portion 110. The connection portion 110 may be connected to the extension tube of the vacuum cleaner or directly to a grip portion to which an upper end of the extension tube is detachably connected.

Furthermore, in the illustrated embodiment, an agitator 114 is rotatably installed just above the inlet 112. The agitator 114 is rotatably supported by both inner side surfaces of the main body 100, and brushes 116 are helically installed on an outer surface of the agitator. The agitator 114 is used for cleaning of a carpet or the like and installed in a state where distal ends of the brushes 116 slightly protrude downward beyond the inlet 112. Therefore, when the agitator 114 rotates, the brushes 116 come into contact with a surface of the carpet or the like so as to shake off the foreign substances such as dirt adhering to the carpet. The foreign substances such as dirt that have been shaken off in such a way are sucked together with the air through the inlet 112.

A driving motor 120 for causing the agitator 114 to rotate is installed within the main body 100. A belt 124 is wound around an output shaft of the driving motor 120 and one end of the agitator 114. Thus, rotational force from the driving motor 120 is transmitted to the agitator 114 through the belt 124. Accordingly, as described above, as the agitator 114 rotates upon cleaning of the carpet, the foreign substances such as dirt can be shaken off from the carpet.

However, various modifications may be made to the configuration for causing the agitator 114 to rotate. For example, if a turbine is installed within a connection duct 130, the turbine rotates by means of the force of a wind generated by the suction. The agitator 114 can be constructed to rotate even by means of connection of the turbine and the agitator through the belt.

The connection portion 110 extends forward to form the connection duct 130. An opening 132 is formed at a front end of the connection duct 130. The air containing the foreign substances sucked through the inlet 112 is introduced into the connection duct 130 through the opening 132 and then into the extension tube of the vacuum cleaner through the connection portion 110 formed at the rear end of the connection duct 130.

An inlet 202 for sucking the air containing the foreign substances is formed at an end of the accessory tool 200. As described above, the accessory tool 200 of the present invention is implemented to be smaller than the main body 100 so that it can easily clean corner portions. Further, the accessory tool 200 may be modified in a variety of types of accessory tools, as described above. It will be apparent that the accessory tool may be constructed in the form of a small accessory tool that is similar to a crevice tool shown in the figures or has a brush.

The accessory tool 200 is constructed to communicate with the main body 100 through the connection hose 220. That is, the connection hose 220 connected to a rear end of the accessory tool 20 may be installed to communicate with a front part of the connection portion 110 or with the connection duct 130 in the main body 130.

With such a connection hose 220 that communicates with the connection duct 130 or the front part of the connection portion 110, the air sucked through the accessory tool 200 is guided into the extension tube of the vacuum cleaner through the connection portion 110.

Further, it is preferred that the accessory tool 200 be detachably installed on the main body 100. In other words, when cleaning is mainly performed using the main body 100, the accessory tool 200 is constructed to move and suck the air containing the foreign substances together with the main body 100 in a state where the accessory tool 200 is mounted on the main body 100. If necessary, the accessory tool 200 can be separated from the main body 100 to be used independently.

Figure 4A:
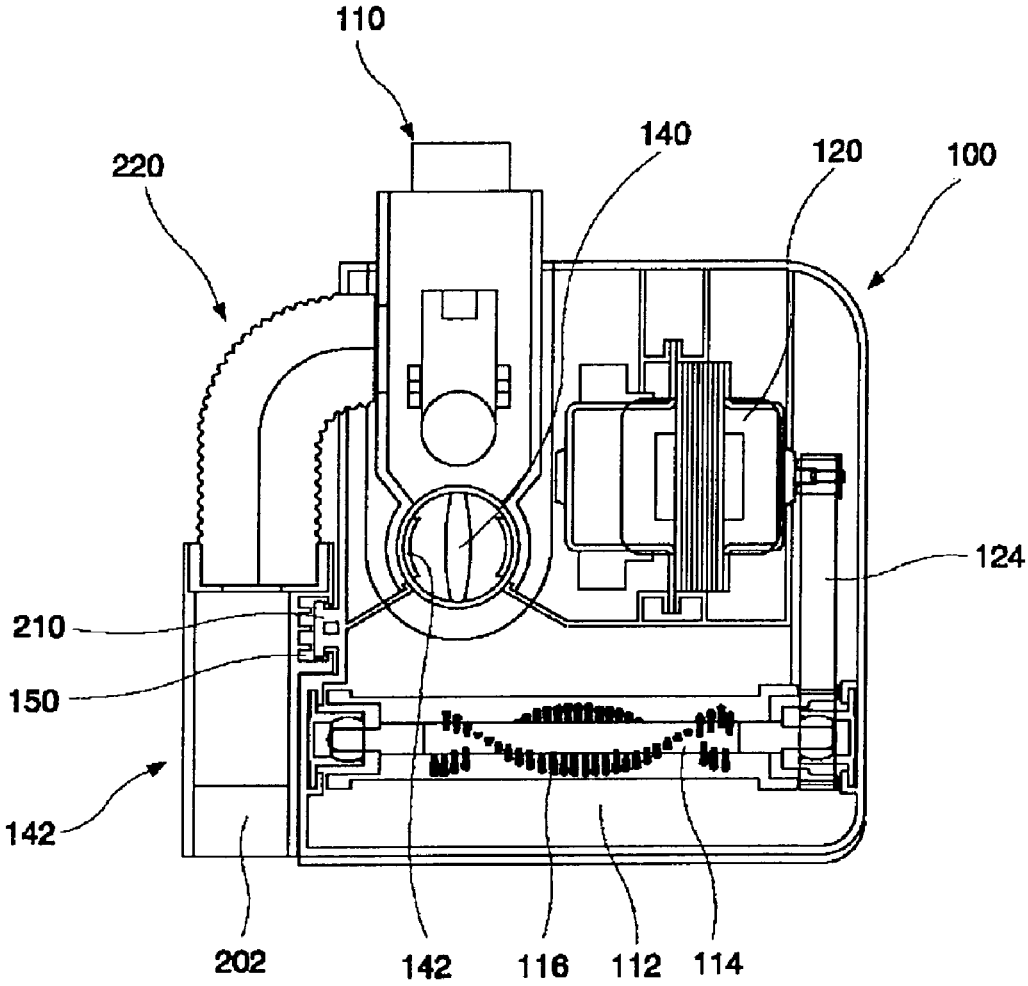
FIG. 4*a* is a cross-sectional view of the suction nozzle of the present invention.
Figure 4B:
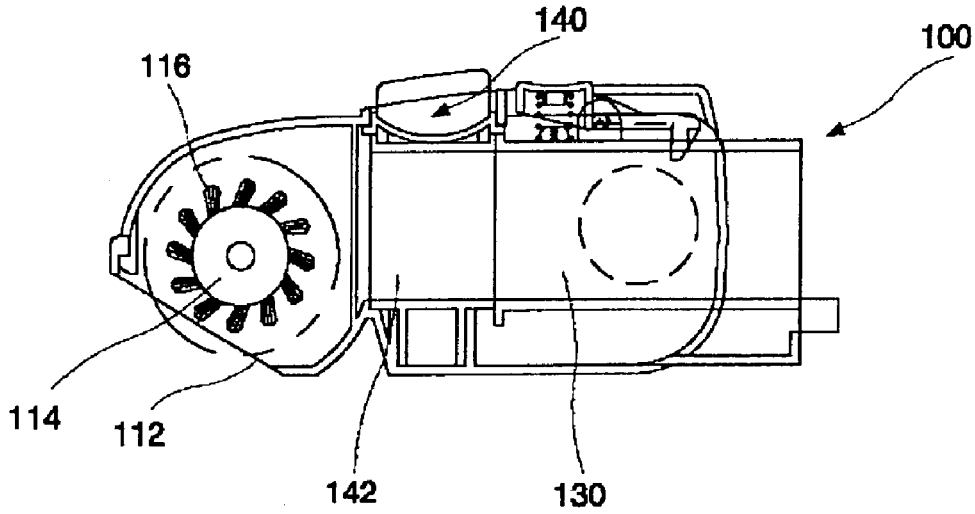
FIG. 4*b* is a longitudinal sectional view of the suction nozzle of the present invention.
Figure 5:
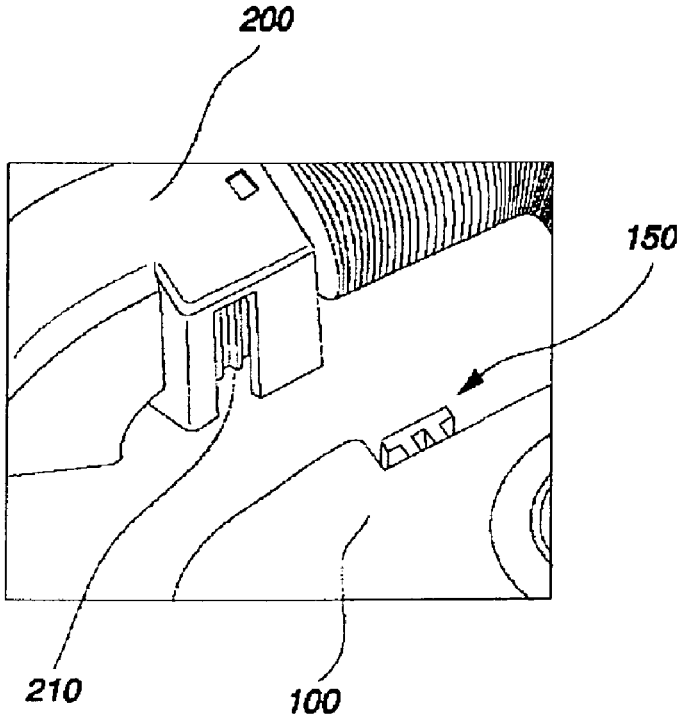
FIG. 5 is a partial perspective view of an accessory tool of the suction nozzle and a main body of the suction nozzle according to the present invention.

Therefore, the accessory tool 200 is detachably installed on the main body 100 and structures for such detachable installation will be described with reference to FIGS. 4*a*, 4*b* and 6(*a*) and (*b*). As shown in the figures, a mounting protrusion 150 is formed to protrude outward from a side surface of the main body 100, and a mounting recess 210 into which the mounting protrusion 150 can be fixedly inserted is formed in a side surface of the accessory tool 200 corresponding to the side surface of the main body.

The mounting protrusion 150 is formed to have such a predetermined vertical length that the accessory tool 200 can be fitted over the mounting protrusion in a vertical direction. The section of the mounting protrusion may be T-shaped in the same manner as the embodiment shown in the figures. Further, the mounting recess 210 has such a predetermined vertical length that it can be fitted over the mounting protrusion 150 in the vertical direction, i.e. downward from above. An upper end of the mounting recess 210 is closed. Thus, the mounting recess 210 of the accessory tool 200 can be fitted over the mounting protrusion 150 downward from above, so that the accessory tool 200 can be mounted on the main body 100 and kept in a fixed state. Accordingly, when cleaning is performed in such a state, the air containing the foreign substances is sucked through the inlet 102 of the main body 100 and even through the inlet 202 of the accessory tool 200.

Moreover, in a case where the accessory tool 200 is required to be separated from the main body 100, for example, in case of cleaning a narrow place that cannot be cleaned using the main body 100, there is no choice but to use the accessory tool 200. In this case, the accessory tool 200 can be separated from the main body and used independently.

In the aforementioned embodiment, it has been described that the accessory tool 200 is detachably installed on the main body 100 by forming the mounting protrusion 150 and the mounting recess 210 and fitting the mounting recess 210 of the accessory tool 200 over the mounting protrusion 150 downward from above. However, it will be apparent that the present invention is not limited thereto. It will be apparent that so far as the accessory tool 20 can be mounted on the main body 100 to be kept in the fixed state or can be separated from the main body to be used independently, various modifications may be made to the connection relationship between the accessory tool 200 and the main body 100 and any known detachable-connection means may be utilized.

In the case where the accessory tool 200 is independently used according to the present invention, it will be apparent that suction power through the accessory tool 200 is further enhanced if the air introduced through the inlet 112 of the main body 100 is blocked.

Figure 6A:
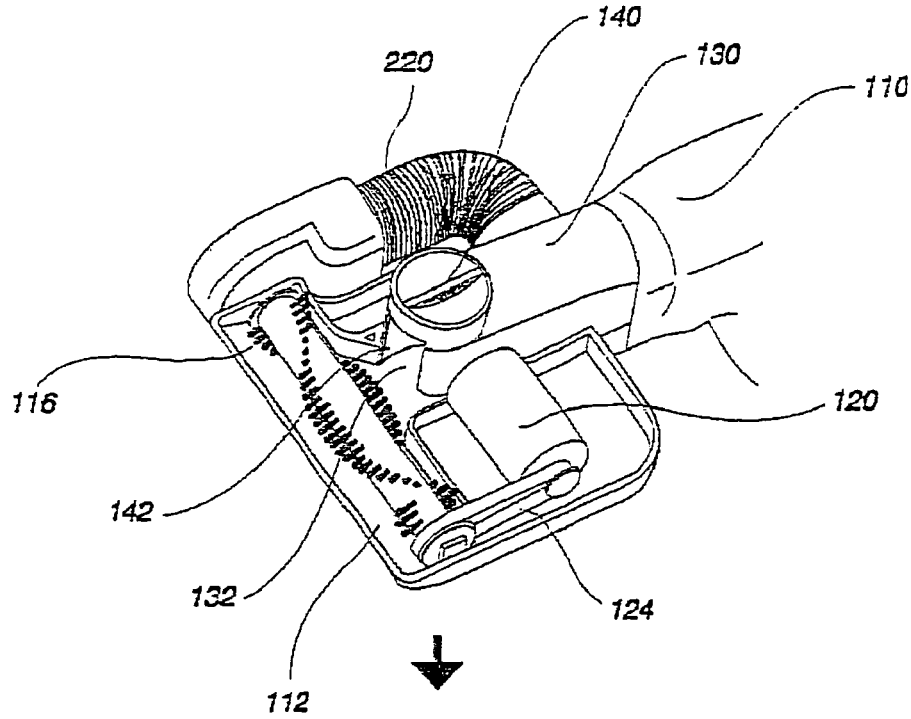
FIGS. 6(*a*) and (*b*) are exemplary views showing a procedure of using the accessory tool of the suction nozzle of the present invention.
Figure 6B:
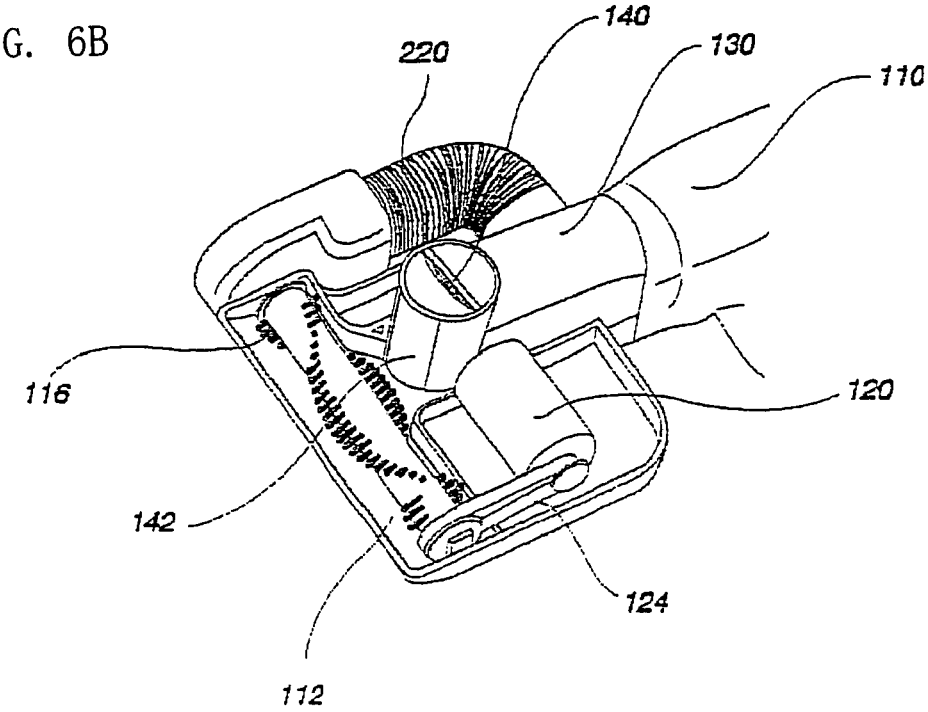

Referring to FIGS. 6(*a*) and (*b*), it can be seen from FIG. 6(*a*) that the opening 132 at the front end of the connection duct 130 installed in the main body 100 is opened. In such a state, it will be apparent that the air sucked through the inlet 112 of the main body 100 is introduced into the connection duct 130 through the opening 132. Further, the air sucked through the inlet 202 of the accessory tool 200 in such a state is introduced into the connection duct 130 through the connection hose 220.

Therefore, when the accessory tool 200 is separated to be used independently in such a state, the suction power through the accessory tool 200 is relatively weak. It will be apparent that when the opening 132 formed at the front end of the connection duct 130 is closed, suction power through the main body 100 does not exist and thus the suction power through the accessory tool 200 becomes relatively strong.

According to the present invention, the suction nozzle is provided with an opening/closing device capable of selectively opening or closing the opening 132. For example, an opening/closing lever 140 is installed above the opening 132 of the connection duct 130. Further, the opening/closing lever 140 is circular in cross section and designed to have an opening/closing plate 142 formed at a lower portion thereof to be interlocked therewith. It is preferred that the opening/closing plate 142 be formed in the shape of an arc corresponding to the opening/closing lever 140 having the circular cross-section.

Furthermore, in the present embodiment, the front end of the connection duct 130 at which the opening 132 is formed is also shaped to correspond to the shape of the opening/closing lever 140. Thus, the opening/closing plate 142 can maintain the closed or opened state of the opening 132.

The state shown in FIG. 6(*a*) is the opened state of the opening 132 where the opening/closing plate 142 of the opening/closing lever 140 is positioned at a side of the connection duct 130. If the accessory tool 200 is intended to be used independently in this state, strong suction power is required. Thus, the opening 132 should be closed using the opening/closing lever 140.

To this end, if the opening/closing lever 140 is rotated in a predetermined direction as shown in FIG. 6(*b*), the opening/closing plate 142 formed at the lower portion of the opening/closing lever 140 is rotated to close the opening 132.

In the state where the opening 132 is closed in such a way, air is not substantially sucked through the inlet 112 of the main body 100. Then, the suction power generated in the main body of the vacuum cleaner is transmitted to the accessory tool 200 and thus stronger suction power is exerted by the accessory tool.

Next, other modified embodiments of the present invention having the same subject as the previous embodiment will be discussed.

The previous embodiment of the present invention is constructed such that the air sucked through both the accessory tool 200 and the main body 100 is introduced into the extension tube of the vacuum cleaner by using the single connection portion 110.

It is sufficient that the connection hose 220 connected to the accessory tool 200 is configured to join a suction passage of the main body 100 at a position just before the connection portion 110. For example, it is possible to cause a rear end of the connection hose 220 to communicate with the connection portion 110 or to be connected to the connection duct 100 in the main body 130, as described above.

Since the opening 132 of the connection duct 130 is to substantially guide the air, which has been sucked through the inlet 112 of the main body 100, into the connection portion 110, it will be apparent that the opening may be of any configuration so far as it can guide the air, which has been sucked through the inlet 112, into the connection portion 110.

Further, various modifications may be made to the configurations of the opening/closing lever 140 and the opening/closing plate 142 for blocking inflow of the air through the inlet 112 of the main body 100. The opening/closing plate 142 is to prevent the air sucked through the inlet 112 from being introduced into the connection duct 130. Thus, those skilled in the art can make various modifications within the technical scope that only the air sucked through the accessory tool 200 is caused to be introduced into the connection portion 110 by blocking the air guided from the interior of the main body 100 into the connection portion 110. For example, other modifications may be made within the scope that that only the air sucked through the accessory tool 200 is caused to be introduced into the connection portion 110 by selectively blocking the interior of the connection duct 130.

Moreover, although the opening/closing plate 142 and the opening/closing lever 140 are constructed to have the arc or circular cross-section in the illustrated embodiment, they are not limited thereto. For example, it will be apparent that any known structures can be employed to selectively block the opening 132 of the connection duct 130 so far as they can block the opening 132.

According to the present invention described above, it can be expected to obtain the following advantages. With the present invention, the main body 100 can be utilized upon cleaning of a floor, and the accessory tool 200 can be utilized, if necessary, as shown in FIG. 3. Therefore, in case of cleaning narrow corner places such as stairs, more efficient cleaning can be performed by utilizing the aforementioned accessory tool 200.

Furthermore, it will be apparent that the suction power through the accessory tool 200 can be substantially enhanced by blocking the opening 132 of the main body 100. Such enhancement of the suction power of the accessory tool means that the cleaning using the accessory tool can be more efficiently performed. Thus, convenience of cleaning can be substantially more improved.

When the agitator installed in the main body 100 of the suction nozzle of the present invention is used, there is convenience in that a carpet can be more efficiently cleaned.

It will be apparent that those skilled in the art can make various modifications within the scope of the technical sprit of the invention, as described above. Further, the present invention should be construed based on the appended claims.

What is claimed is:

1. A suction nozzle for a vacuum cleaner, the suction nozzle comprising:

a main body including an inlet which forms a primary suction portion configured to suck air into the main body;

a connection portion provided at a rear portion of the main body of the suction nozzle and configured to guide the sucked air to a main body of a vacuum cleaner;

an accessory tool including an inlet which forms a secondary suction portion physically separate from the primary suction portion configured to suck air into the accessory tool; and a connection hose configured to connect the accessory tool to the main body of the suction nozzle so as to form an air flow path therebetween, wherein a suction force is conveyed through both the primary and secondary suction portions when the accessory tool is in a stowed position and the vacuum cleaner is operational.

2. The suction nozzle as claimed in claim 1, wherein the accessory tool is configured to be detachably mounted to a side surface of the main body of the suction nozzle.

3. The suction nozzle as claimed in claim 2, further comprising:

a vertical mounting protrusion provided at one side of the main body of the suction nozzle; and a mounting recess provided at a side of the accessory tool, and configured to fit over the mounting protrusion so as to detachably mount the accessory tool to the main body of the suction nozzle.

4. The suction nozzle as claimed in claim 3, wherein the vertical mounting protrusion is T shaped.

5. The suction nozzle as claimed in claim 4, wherein the mounting recess is configured to be slidably attached and detached from the vertical mounting protrusion.

6. The suction nozzle as claimed in claim 1, further comprising:

a connection duct provided in the main body of the suction nozzle and in communication with the connection portion; and an opening formed at a front end of the connection duct and configured to guide air which has been sucked into the main body of the suction nozzle into the connection duct.

7. The suction nozzle as claimed in claim 6, wherein a rear end of the connection hose is configured to be connected to the connection duct so as to communicate with the main body of the suction nozzle.

8. The suction nozzle as claimed in claim 6, wherein a rear end of the connection hose is configured to be connected to the connection portion so as to communicate with a rear portion of the main body of the suction nozzle.

9. The suction nozzle as claimed in claim 6, further comprising an opening/closing means for opening and closing the opening.

10. The suction nozzle as claimed in claim 9, wherein the opening/closing means comprises:

an opening/closing lever provided above a front end of the connection duct; and an opening/closing plate configured to open and close the opening.

11. The suction nozzle as claimed in claim 10, wherein the lever is substantially circular in cross section.

12. The suction nozzle as claimed in claim 11, wherein the lever is configured to be rotatably coupled to the connection duct.

13. The suction nozzle as claimed in claim 12, wherein side portions of the connection duct which define the opening are arcuate, and wherein the opening is opened and closed in response to a rotation of the lever.

14. The suction nozzle as claimed in claim 1, further comprising:

an agitator rotatably installed above the inlet of the main body of the suction nozzle; and rotation device configured to rotate the agitator.

15. The suction nozzle as claimed in claim 14, wherein the rotation device comprises:

a driving motor provided in the main body of the suction nozzle; and a belt configured to transmit a rotational force from the driving motor to the agitator.

16. The suction nozzle as claimed in claim 1, wherein the accessory tool is smaller than the main body of the suction nozzle.

17. The suction nozzle as claimed in claim 1, wherein the main body inlet and the accessory tool inlet are configured to suck debris from a surface to be cleaned into the main body of the suction nozzle and the accessory tool, respectively.

18. The suction nozzle as claimed in claim 1, wherein the primary and secondary suction portions both face the same surface to be cleaned when the accessory tool is in the stowed position.

19. The suction nozzle as claimed in claim 1, wherein the primary and the secondary suction portions are substantially side by side and coplanar when the accessory tool is in the stowed position.

20. A suction nozzle for a vacuum cleaner, comprising:

a main body including an inlet comprising a first suction portion configured to suck air into the main body;

a connection portion provided at a rear portion of the main body of the suction nozzle and configured to guide the sucked air to a main body of the vacuum cleaner;

a first duct configured to guide the air sucked in through the inlet into the connection portion;

an accessory tool detachably mounted to the main body of the suction nozzle, and including an inlet comprising a second suction portion separate from the first suction portion and configured to suck air into the accessory tool a connection hose configured to connect the accessory tool and an interior of the main body of the suction nozzle;

a second duct configured to guide the air sucked through the connection hose into the connection portion; and an opening/closing device configured to selectively open and close the first duct, wherein a suction force conveyed through the second suction portion augments a cleaning capacity provided by a suction force conveyed through the first suction portion when the accessory tool is in a stowed position and the vacuum cleaner is operational.

21. The suction nozzle as claimed in claim 20, wherein the accessory tool is smaller than the main body of the suction nozzle.

22. The suction nozzle as claimed in claim 20, wherein the accessory tool inlet and the main body inlet both face the same surface to be cleaned when the accessory tool is in the stowed position.

23. The suction nozzle as claimed in claim 20, wherein the accessory tool inlet and the main body inlet are substantially side by side and coplanar when the accessory tool is in the stowed position.

* * * * *